US008875803B2

(12) United States Patent
Galehr et al.

(10) Patent No.: US 8,875,803 B2
(45) Date of Patent: Nov. 4, 2014

(54) METHOD FOR TIGHTENING BOLT CONNECTION BY ELONGATION OF BOLT

(75) Inventors: Lothar Galehr, Tschagguns (AT); Manuel Zint, Vandans (AT); Juergen Wachter, Gortipohl (AT)

(73) Assignee: Liebherr-Werk Nenzing Ges.m.b.H, Nenzing (AT)

( * ) Notice: Subject to any disclaimer, the term of this patent is extended or adjusted under 35 U.S.C. 154(b) by 441 days.

(21) Appl. No.: 12/987,272

(22) Filed: Jan. 10, 2011

(65) Prior Publication Data

US 2011/0168418 A1 Jul. 14, 2011

(30) Foreign Application Priority Data

Jan. 8, 2010 (DE) ..... 10 2010 004 218
Mar. 1, 2010 (DE) ..... 10 2010 009 712

(51) Int. Cl.

| | |
|---|---|
| ***B25B 23/145*** | (2006.01) |
| ***B25B 23/14*** | (2006.01) |
| ***B25B 21/02*** | (2006.01) |
| ***B25B 21/00*** | (2006.01) |
| *B28B 21/02* | (2006.01) |
| *B25B 23/147* | (2006.01) |

(52) U.S. Cl.

CPC ..... *B25B 21/005* (2013.01); *B25B 23/14* (2013.01); *B25B 23/1405* (2013.01); *B28B 21/02* (2013.01); *B25B 23/1475* (2013.01); *B25B 23/145* (2013.01)

USPC ..... 173/1; 173/176; 173/183

(58) Field of Classification Search

CPC ..... B25B 23/145; B25B 21/005; B25B 21/00

USPC ..... 173/1, 176, 183, 173

See application file for complete search history.

(56) References Cited

U.S. PATENT DOCUMENTS

| | | | | |
|---|---|---|---|---|
| 4,037,282 | A * | 7/1977 | Dahl | 470/11 |
| 5,492,185 | A * | 2/1996 | Schoeps et al. | 173/177 |
| 6,782,594 | B2 * | 8/2004 | Shoberg | 29/407.03 |
| 6,843,326 | B2 * | 1/2005 | Tambini | 173/1 |
| 2004/0050567 | A1 * | 3/2004 | Tambini | 173/93.5 |
| 2004/0144552 | A1 * | 7/2004 | Suzuki et al. | 173/2 |
| 2009/0084568 | A1 * | 4/2009 | Arimura et al. | 173/104 |

FOREIGN PATENT DOCUMENTS

DE 43 31 846 A1 3/1994

OTHER PUBLICATIONS

Translation of Abstract of DE 43 31 846 A1.
Search Report for DE10 2010 009 712.8 (Priority German Patent Application) from German Patent and Trademark Office.

* cited by examiner

*Primary Examiner* — Michelle Lopez
(74) *Attorney, Agent, or Firm* — The PL Law Group, PLLC

(57) ABSTRACT

The present invention relates to a method for tightening a bolt connection through elongation of the bolt where strokes of a power element, especially a hydraulic cylinder, are converted into a rotational movement of a tightening tool. The method according to an embodiment of the present invention is carried out in at least two steps. As a first step, the bolt is first tightened to a predetermined snug torque. As a second step, the bolt is then tightened up through a predetermined number of complete strokes of the power element of the power wrench. In this way, a torque method is combined with a rotational angle method that is controlled by the number of strokes.

9 Claims, 1 Drawing Sheet

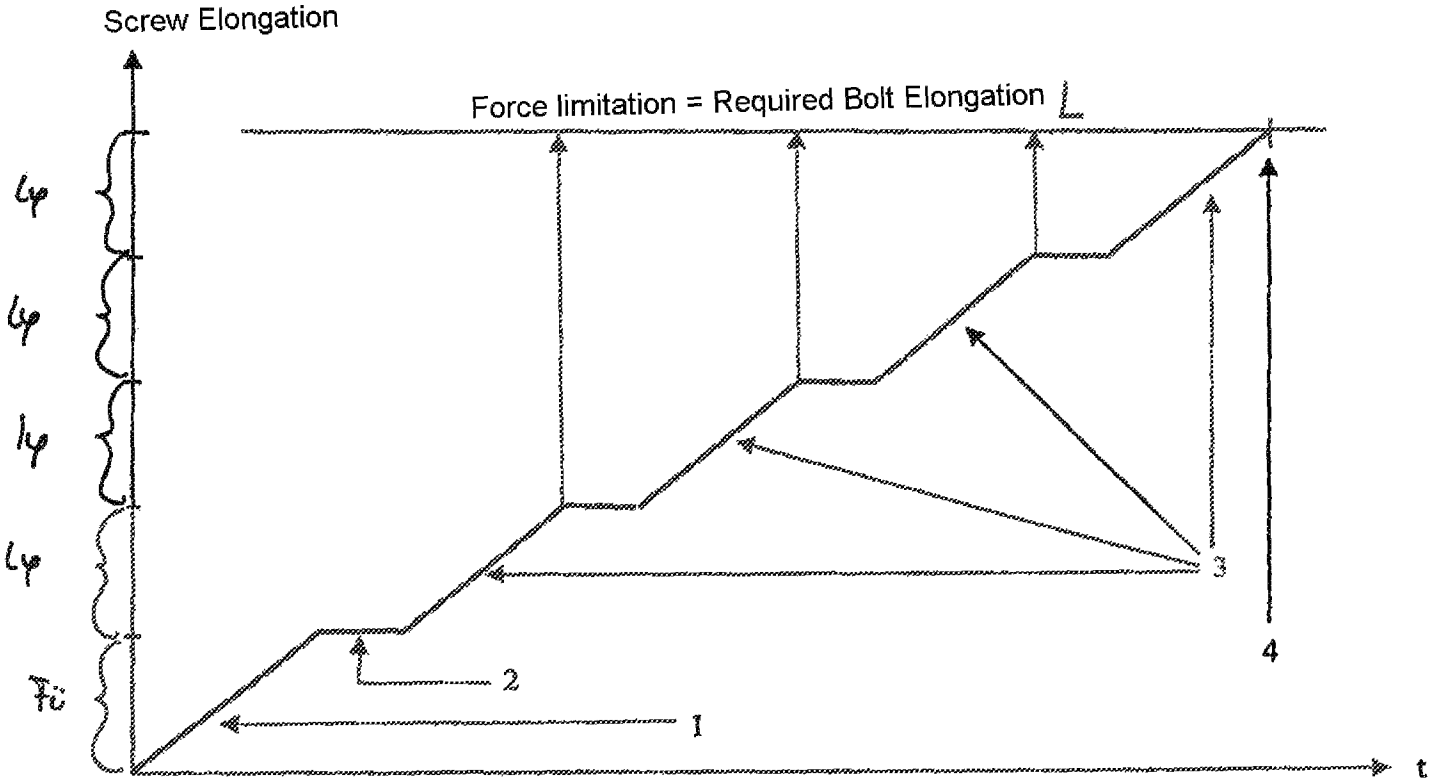
Screw Elongation
Force limitation = Required Bolt Elongation $L_e$
1
2
3
4
t

METHOD FOR TIGHTENING BOLT CONNECTION BY ELONGATION OF BOLT

CROSS-REFERENCE TO RELATED APPLICATION AND CLAIM OF PRIORITY

The application claims the benefit of German Patent Application Nos. 10 2010 004 218.8, filed on Jan. 8, 2010, and 10 2010 009 712.8 filed on Mar. 1, 2010 in the German Patent and Trademark Office, the disclosures of which are incorporated herein in their entirety by reference.

BACKGROUND

1. Field of the Invention

The present invention relates to a method for tightening a bolt connection by elongation of the bolt where a power wrench is used and where the strokes of a power element, especially of a hydraulic cylinder, are converted into a rotational movement of a tightening tool. In particular, the power wrench used should be a tool where the angle of rotation transcribed per stroke of the power element forms a constant.

2. Description of the Related Art

In the production of high-strength pre-stressed bolt connections, adjustment of the pre-stressing is often necessary in order to produce a specified elongation of the bolt within a relatively small process-reliable tolerance range.

Bolt elongation may be checked, for example, by continuous ultrasonic measurement in order to ensure the correct elongation of the bolt. In addition, methods are known for tightening bolt connections where the angle of rotation of the bolt is measured by a rotation angle sensor during application of the force while the power wrench is controlled using the values of the rotation angle sensor. However, in this case, conventional power wrenches without such sensors can no longer be used. In addition, these engineering control methods are quite costly.

BRIEF DESCRIPTION OF THE DRAWING

A more complete appreciation of the invention, and many of the attendant advantages thereof, will be readily apparent as the same becomes better understood by reference to the following detailed description when considered in conjunction with the accompanying drawing in which like reference symbols indicate the same or similar components, wherein:

FIG. 1 is a diagram where the bolt elongation is shown during the implementation of a method according to the invention.

SUMMARY

According to an aspect of the present invention, a method for tightening a bolt connection that can be easily and cost-effectively implemented and yet facilitate the obtaining of a specified process-reliable bolt elongation with small tolerances is provided.

According to an aspect of the present invention, the method for tightening a bolted connection with elongation of a bolt using a power wrench where strokes of a power element are converted into a rotational movement of a tightening tool, the method including: subjecting the bolted connection to a predetermined snug torque; and tightening the bolted connection through a predetermined number of the strokes of the power element of the power wrench.

According to an aspect of the present invention, the method further includes presetting a desired total elongation; and determining a snug torque to achieve a snug elongation which is so calculated that the total required elongation may be achieved by the snug elongation and a number of the strokes of the power element of the power wrench.

According to an aspect of the present invention, the method may further include determining a angle of a rotation generated by the stroke of the power element of the power wrench used.

According to an aspect of the present invention, the method may further include determining the elongation of the bolt generated through the stroke of the power element of the power wrench used and/or by a angle of rotation.

According to an aspect of the present invention, the rotation angle generated by the stroke of the power element of the power wrench used and/or the elongation generated by the stroke of the power element of the power wrench used and/or the elongation of the bolt generated by the rotation angle for the type of power wrench and/or type of bolt used is determined in advance.

According to an aspect of the present invention, the snug torque lies between 5% and 50% of a maximum tightening torque.

According to an aspect of the present invention, wherein a maximum tightening torque of the power wrench and/or a maximum force at which the power element is applied, is so adjusted that the final stroke is completely executed.

According to an aspect of the present invention, there is no measurement of the angle of rotation using a rotation angle sensor and/or the power wrench used does not have a rotation angle sensor.

According to an aspect of the present invention, the control of the power wrench is manual or by a simple control of the specified number of strokes.

According to an aspect of the present invention, a method of utilizing a power wrench where strokes of a power element are converted into a rotational movement of a tightening tool includes tightening the bolted connection through a predetermined number of the strokes of the power element of the power wrench after a bolted connection is subjected to a predetermined snug torque.

DETAILED DESCRIPTION

In the method according to an embodiment of the present invention, a power wrench is used for tightening a bolt connection through elongation of the bolt where strokes of a power element, especially a hydraulic cylinder, are converted into a rotational movement of a tightening tool. The method according to an embodiment of the present invention is carried out in at least two steps. As a first step, the bolt is first tightened to a predetermined snug torque. As a second step, the bolt is then tightened up through a predetermined number of complete strokes of the power element of the power wrench. In this way, a torque method is combined with a rotational angle method that is controlled by the number of strokes.

The method according to an embodiment of the present invention can also be used with conventional power wrenches to achieve controlled overall elongation to tight tolerances. In particular, tolerances of less than ±10% can be achieved. Thus the use of expensive and relatively large rotary angle wrenches with rotary angle sensors can be avoided. In addition, costly controls that use sensor values such as those generated by angle sensors based on a volume measurement of the hydraulic fluid or measurement of the time, may be completely avoided.

The influence of the coefficient of friction is minimized through the method according to an embodiment of the present invention when compared with the tightening process of the pure torque method so that process reliability is improved. In particular, the effects of friction are exclusively present in the first step, i.e., in the snug torque range. In the second step, the step of the process that is controlled by the number of strokes, on the other hand, friction has no effect on bolt elongation. Moreover, the method is extremely simple and inexpensive to apply.

According to the invention, the snug torque is so adapted that the specified bolt elongation can subsequently be achieved with greater accuracy and process reliability through completely executed strokes of the tool. In the method according to an embodiment of the present invention, therefore, the two steps advantageously include the specification of a desired overall elongation and the specification of a snug torque required to achieve a given snug torque elongation so that the desired total elongation can be achieved based on the snug torque elongation and a number of complete strokes of the power element of the power wrench. The total elongation is thus composed of the snug torque elongation achieved by tightening the bolt connection to the snug torque, and the elongation achieved through the number of complete strokes of the power element of the power wrench.

The method according to an embodiment of the present invention also advantageously includes the step of determining the angle of rotation generated by a complete stroke of the power element of the power wrench used. This results in a tool constant by means of which the number of complete strokes required for a given elongation may be calculated.

In order to determine the total angle of rotation resulting from several complete strokes, it is only necessary to determine the angle of rotation of the power element of the power wrench that is generated by a single complete stroke of the power element. Then the number of complete strokes required to achieve the total angle of rotation in the second step of the process may be calculated by simple multiplication. Alternatively, however, the angle of rotation generated by several complete strokes may be determined directly.

Further advantageously, an embodiment of the present invention includes the step of determining the elongation of the bolt produced by a single complete stroke of the power element of the power wrench used. If the elongation of the bolt per complete stroke of the power element is known, then the elongation achieved by the bolt during the second step may be calculated by a simple multiplication of the number of complete strokes. Alternatively, however, the elongation obtained through several complete strokes may also be determined directly.

The elongation of the bolt by an entire stroke is dependent, on the one hand, on the rotation angle generated by a complete stroke of the power element of the power wrench, and, on the other hand, on the geometry of the bolt, in particular by the lead of the screw thread.

The method according to an embodiment of the present invention may thus include the step of determining the elongation of the bolt generated by a certain angle of rotation. If the elongation of the bolt for a given angle of rotation is known, then with knowledge of the angle of rotation generated by a complete stroke, the elongation generated by a complete stroke of the power element may be determined. Alternatively, the elongation of the bolt per complete stroke may also be determined directly.

Advantageously, an embodiment of the present invention allows the determination in advance of the angle of rotation generated by a complete stroke of the power element of the power wrench or type of power wrench used. The angle of rotation per stroke of the power element must therefore be determined only once for each power wrench or type of power wrench, and may then be used in a variety of bolting processes.

Further advantageously, an embodiment of the present invention provides for the determination in advance of an elongation generated by certain angle of rotation of the bolt for the type of bolt used. Here also, this determination only needs to be done once in advance and can then be used in a variety of bolting processes.

Further advantageously, the elongation of the bolt generated by a complete stroke of the power element of the power wrench used may be determined in advance for the type of power wrench and the type of bolt used.

The determination of the above values may be made either through tests, or by mathematical calculations based on the geometry of the power wrench and/or the bolt used. Preferably, the determination should be carried out by measurement. In particular, it would be preferable to perform measurements with a number of similar power wrenches and/or bolts and an average value used to determine the required values. Further advantageously, the measurement might be carried out at different torque values, enabling the value used to be based on an average.

With knowledge of these corresponding values, the number of complete strokes required as well as the necessary snug torques may be determined for a desired elongation of the bolt, and where the snug torque is so adjusted that the corresponding complete stroke generates the desired total elongation.

As an alternative to this method, the number of complete strokes as well as the necessary snug torque required for a desired elongation may be determined directly through tests. This determination may then be made preferably in advance for each of the power wrenches and/or type of power wrenches used and/or the type of bolt used. The corresponding values for tightening the bolt connection may thus be determined.

In the method according to the invention, the snug torque is preferably between 5% and 50% of the maximum tightening torque. The snug torque is thereby also preferably between 15% and 35% of the maximum tightening torque, or preferably about 25% of the maximum tightening torque. Preferably, the snug torque is so specified that a certain elongation of the bolt already takes place during the first step of the process.

The snug torque does not necessarily have to be applied using the same power wrench that is used in the second step to apply a predetermined number of complete strokes of the power element to the bolted connection. In particular, the snug torque may also be applied using a torque wrench or a rotary-motor driven power wrench or the like. The snug torque is preferably applied, however, using the same power wrench that is used in the second step. In particular, this involves a torque wrench. The snug torque is preferably achieved through the pressure of hydraulic fluid that is applied through the hydraulic cylinder of the power wrench.

The method according to an embodiment of the present invention is less sensitive to difficult-to-control coefficients and other influencing factors in the bolting process when compared to the pure torque procedure, as the torque control is used first only for the application of the snug torque that is significantly less than the maximum tightening torque. Thus, the influence of friction is limited to this area. This is followed by the use of complete strokes to give a simple and effective control over the elongation of the bolt based on the angle of rotation.

Preferably in the method according to an embodiment of the present invention, the maximum tightening torque of the power wrench or the maximum force applied by the power element is so adjusted that the last stroke is performed in full. Preferably, this final stroke, at least, is monitored through a simple control.

Alternatively, however, the maximum tightening torque of the power wrench or the maximum force applied by the power element may be set at a predetermined value that would also be used as the final value in a pure torque-controlled method. The method according to an embodiment of the present invention involving tightening a bolt in two steps also allows, in this case, a particularly process-reliable elongation of the bolt, where the maximum elongation is set to the same value both through the force limitation as well as the snug elongation and the number of strokes.

As already illustrated above, the method according to an embodiment of the present invention uses simple means to obtain highly accurate bolt elongation, particularly in a tolerance range of ±10%. Advantageously, no measurement of the bolt angle is required using a rotation angle sensor. Such a measurement of the bolt angle using a rotation angle sensor may be omitted, since in the second step the rotation angle may be determined through the complete strokes of the tool and the bolt geometry. In particular, the method may be performed using power wrenches that do not have a rotation angle sensor.

Furthermore, a control that controls the power wrench by sensor data such as angle sensors, volume measurement and time measurement, may also be dispensed with. In particular, electronic control may be dispensed with. Furthermore, control that depends on the rotation of the power wrench via corresponding electronic control and/or hydraulic control may be dispensed with.

Further advantageously, in the method according to an embodiment of the present invention the control of the power wrench is performed manually or by simple control of the required number of strokes.

The embodiment of the present invention may include in addition to the method presented above, the use of a power wrench, where strokes of a power element, particularly a hydraulic cylinder, are converted into a rotational movement of the power wrench. This offers the same benefits from the use of the power wrench as those already shown with respect to the method presented above.

The power wrench used in the method according to an embodiment of the present invention may have a power element; in particular in the form of a hydraulic piston-cylinder drive whose linear movement is converted via a corresponding device into the rotary motion of a tightening tool. The tightening tool has, in particular, a connecting element for releasable connection with a bolt and/or a nut. The tightening tool may, in particular, be a tightening element or tightening element attachment through which a positive rotary connection may be made with a bolt or a nut. In particular, this relates to positive tool attachments.

Advantageously, the movement of the power element in one direction is converted into a rotational movement of the tightening tool, while the tightening tool does not move during the return movement of the power element. Further advantageously, the power wrench includes a ratchet device by which the intermittent movements of the power element are converted into rotary motion in a given direction.

Advantageously, further, monitoring of the stroke of the power wrench may be made by a simple sensor close to the power element so that the tool geometry does not need to be changed. This provides monitoring of the limit position of all strokes.

The embodiments of the present invention will now be described with reference to embodiments and a drawing.

FIG. 1 is a diagram where the bolt elongation is shown during the implementation of a method according to the invention.

Before carrying out the actual tightening of the bolt, a tool constant $\phi$ must be determined for the power wrench or type of power wrench used, where the constant describes the angle of rotation generated by a complete stroke of the power element. This constant $\phi$ only has to be calculated once for each tool or for each type of tool. This tool constant may be determined either by appropriate tests or theoretically based on the tool geometry.

The method according to the invention may therefore be used for all tightening tools where such a correlation between tool stroke and elongation or the angle of rotation may be determined.

Furthermore, the elongation l of the bolt must be determined based on the angle of rotation of the type of bolt used. This may be done in advance for each type of bolt. Again, this may in turn be done either by a measurement, or by a corresponding theoretical calculation based on the tool geometry.

Based on these two values, the $l\phi$ elongation per complete stroke may now be calculated for any combination of power wrench and bolt used. Alternatively, the elongation per complete stroke of the power element may be directly determined for a given combination of power wrench and bolt.

The actual tightening process is then performed in two stages. In stage 1, a predetermined snug torque is applied to the bolt connection. In stage 2, there is then a bolt elongation dependent on the number of strokes. The specified bolt elongation may thus be obtained with process reliability within the required tolerance range and where the snug torque is so adjusted that the desired overall elongation is obtained by the fully executed tool strokes.

The required snug torque may be determined, for example, by means of experiment. Usually a snug torque of about 25% of the total required tightening torque range is used. The snug torque may be applied, for example, by means of a torque wrench, power wrench and the like. The required number of strokes of the tool for a given bolt elongation based on complete strokes may also be determined by experiment.

The total elongation of the bolt may be calculated as follows:

$$L=Fü+n*l*\phi$$

where L is the total elongation (required or calculated bolt elongation);

"Fü" is the snug elongation;

n is the number of strokes;

l is the screws constant (lengthening of the screw per degree); and $\phi$ is the tool constant (degrees per tool stroke)

Alternatively, instead of the screw constant I and the tool constant $\phi$, a single constant k can be used, which describes the elongation of the screw per tool stroke, so that $L=Fü+k*\phi$.

The method according to an embodiment of the present invention is again demonstrated in more detail in FIG. 1. Here, the bolt elongation L over time t is plotted on a chart. In phase 1, a snug elongation is obtained by applying a predetermined snug torque. Then, the remaining elongation of the bolt is obtained through one or more complete strokes, 3. At point 4, the required bolt elongation is achieved. The snug torque is then so adjusted that the required elongation may be obtained through the following complete strokes of the tightening tool.

The plateau phase 2 in the diagram between the snug elongation and the complete strokes corresponds to the return stroke of the power element. Here, the power element is returned to its original position without any rotation of the bolt or elongation of the bolt taking place.

Furthermore, the torque or the force is so limited that the final stroke is carried out fully. This may be assured by an appropriate control device that monitors the final stroke at least. The torque or force limitation may thus be set above the maximum operating pressure provided by the tool assembly for the power wrench.

The method according to the invention makes possible a simple and highly accurate bolt elongation in the ±10% tolerance range without any sensors or control of the power wrench. In particular, rotation angle sensors, volume measurement, time measurement and the like are omitted. This makes possible increased accuracy even when using conventional torque-rotation angle wrenches.

The method according to an embodiment of the present invention achieves torque-rotation angle tightening through tools with a piston drive that effect the elongation based on complete strokes of the piston. The tool and bolt geometry determine the snug torque and the final elongation of the bolt connections.

In particular, the method according to the embodiments of the present invention offers at least some the following advantages:

- This method makes possible highly accurate bolt elongation in the ±10% tolerance range without using any sensors or control (angle sensors, volume measurement, time, measurement, etc. . . . )!
- Avoids costly tool conversion (conventional tools where the angle of rotation per stroke may be determined, may be used; for example, conventional torque wrenches)
- Minimization of the tool size
- The space required for standard rotation angle tools (rotation angle sensors) is not necessary.
- Coefficient of friction influences minimized during bolting process
- Improvement of process reliability
- Inspection costs reduced; continual testing (ultrasonic measurements) may be reduced
- Implementation of torque-rotation angle tightening without rotation angle sensors on tools with a piston drive
- Tool and bolt geometry determine snug torque, number of strokes and final elongation of the bolted connection
- Following snug assembly, the required bolt elongation is achieved through the execution of complete tool strokes
- Force limitation (max. force setting of the tool assembly) prevents overloading of the bolt
- Frictional influences are exclusively present in the snug torque range (snug torque method)

While the invention has been described in terms of what is presently considered to be the most practical and preferred Embodiments, it is to be understood that the invention needs not be limited to the disclosed Embodiments. On the contrary, it is intended to cover various modifications and similar arrangements included within the spirit and scope of the appended claims, which are to be accorded with the broadest interpretation so as to encompass all such modifications and similar structures.

What is claimed is:

1. A method for tightening a bolted connection with elongation of a bolt using a power wrench where linear movement of a hydraulic cylinder is converted into a rotational movement of a tightening tool, the method comprising:

determining an angle of a rotation generated by a stroke of the hydraulic cylinder of the power wrench used;

subjecting the bolted connection to a predetermined snug torque; and tightening the bolted connection through a predetermined number of strokes of the hydraulic cylinder of the power wrench, wherein is determined in advance the rotation angle generated by the stroke of the hydraulic cylinder of the power wrench used and/or the elongation generated by the stroke of the hydraulic cylinder of the power wrench used and/or the elongation of the bolt generated by the rotation angle for the type of power wrench and/or type of bolt used.

2. The method according to claim 1, further comprising:

presetting a desired total elongation; and determining a snug torque to achieve a snug elongation which is so calculated that the total required elongation may be achieved by the snug elongation and a number of the strokes of the hydraulic cylinder of the power wrench.

3. The method according to claim 1, where the snug torque lies between 5% and 50% of a maximum tightening torque.

4. The method according to claim 1, wherein a maximum tightening torque of the power wrench and/or a maximum force at which the hydraulic cylinder is applied, is so adjusted that the final stroke is completely executed.

5. A method for tightening a bolted connection with elongation of a bolt using a power wrench where linear movement of a hydraulic cylinder is converted into a rotational movement of a tightening tool, the method comprising:

subjecting the bolted connection to a predetermined snug torque; and tightening the bolted connection through a predetermined number of strokes of the hydraulic cylinder of the power wrench, wherein there is no measurement of the angle of rotation using a rotation angle sensor and/or the power wrench used does not have a rotation angle sensor.

6. The method according to claim 1, wherein the control of the power wrench is manual or by a simple control of the specified number of strokes.

7. The method according to claim 5, further comprising:

determining an angle of rotation generated by a single complete stroke of the of the hydraulic cylinder; and calculating, with the determined angle generated by the single complete stroke, the predetermined number of strokes required to achieve a predetermined angle of rotation.

8. A method of utilizing a power wrench where linear movement of a hydraulic cylinder is converted into a rotational movement of a tightening tool, the method comprising:

tightening the bolted connection through a predetermined number of strokes of the hydraulic cylinder of the power wrench after a bolted connection is subjected to a predetermined snug torque, wherein there is no measurement of the angle of rotation using a rotation angle sensor and/or the power wrench used does not have a rotation angle sensor.

9. The method according to claim 8, further comprising:

determining an angle of rotation generated by a single complete stroke of the of the hydraulic cylinder; and calculating, with the determined angle generated by the single complete stroke, the predetermined number of strokes required to achieve a predetermined angle of rotation.

* * * * *